US007699259B2

(12) United States Patent
Rawcliffe et al.

(10) Patent No.: US 7,699,259 B2
(45) Date of Patent: Apr. 20, 2010

(54) APPARATUS FOR DISPENSING AND TENSIONING WIRE

(76) Inventors: Stephen Graham Patrick Rawcliffe, Moorgate Farm, Dinckley, Langho, Blackburn (GB) BB6 8AN; John Brewer, Moorgate Farm, Dinckley, Langho, Blackburn (GB) BB6 8AN ( * ) Notice: Subject to any disclaimer, the term of this patent is extended or adjusted under 35 U.S.C. 154(b) by 816 days.

(21) Appl. No.: 10/585,979

(22) PCT Filed: Dec. 22, 2004

(86) PCT No.: PCT/GB2004/005374

§ 371 (c)(1),
(2), (4) Date: Jul. 13, 2006

(87) PCT Pub. No.: WO2005/068751

PCT Pub. Date: Jul. 28, 2005

(65) Prior Publication Data

US 2009/0014702 A1 Jan. 15, 2009

(30) Foreign Application Priority Data

Jan. 13, 2004 (GB) ..... 0400763.9
Jan. 22, 2004 (GB) ..... 0401444.5

(51) Int. Cl.
*B65H 16/02* (2006.01)

(52) U.S. Cl. ..... 242/557; 242/403; 242/533.8; 256/37

(58) Field of Classification Search ..... 242/557, 242/533.8, 403; 256/37
See application file for complete search history.

(56) References Cited

U.S. PATENT DOCUMENTS 3,048,348 A * 8/1962 Griffin ..... 242/422.5
4,775,114 A * 10/1988 Farnsworth ..... 242/422.8
5,163,634 A * 11/1992 Moon et al. ..... 242/419
5,582,216 A * 12/1996 Smith et al. ..... 140/107
6,302,156 B1 * 10/2001 Lardet et al. ..... 140/16
6,360,984 B1 * 3/2002 England ..... 242/557

* cited by examiner

*Primary Examiner*—Sang Kim
(74) *Attorney, Agent, or Firm*—Conley Rose, P.C.

(57) ABSTRACT

An apparatus for dispensing and tensioning wire from a coil, the apparatus comprising a frame (1) for attaching to a vehicle, means (19) for mounting at least one coil of wire for rotation, a lever arm member (21) pivotally mounted with respect to the frame and having a guide (27, 29) co-operable with the wire in use, and a play-out path for the wire defined between an abutment (13) of the frame and an abutment (33) carried by the lever arm member, the lever arm having a first operative position in which the respective abutments are spaced apart to allow play-out of the wire around said guide, and the lever arm having a second operative position in which it is moveable pivotably about said pivot point to cause wire to be trapped between the respective abutments.

22 Claims, 7 Drawing Sheets

Section 'A' - 'A'

APPARATUS FOR DISPENSING AND TENSIONING WIRE

Figure 1:
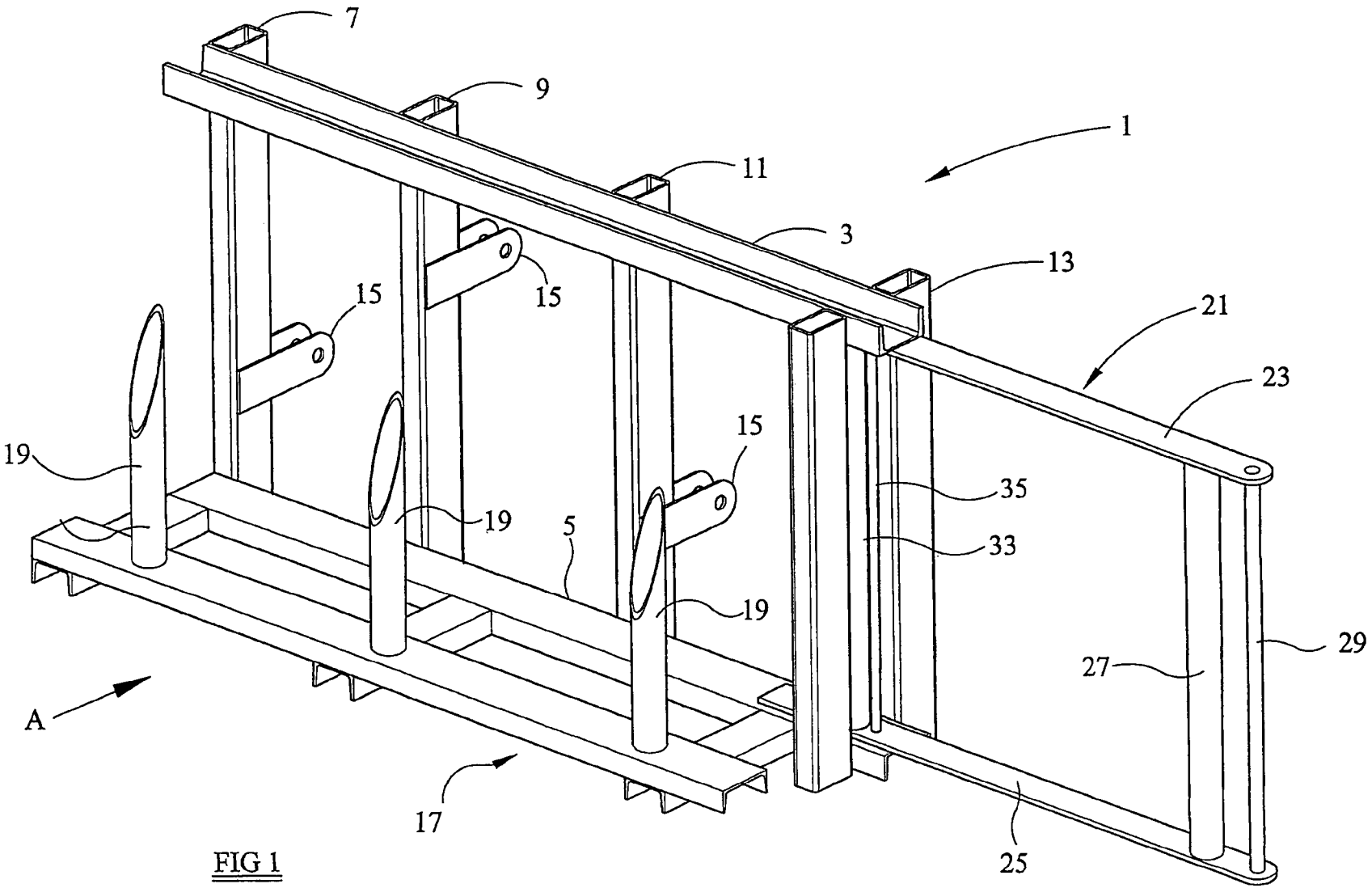

The present invention relates to apparatus for dispensing and tensioning wire.

It is particularly intended for use with rolls of sheep or deer netting, but can be used with other types of wire, including barbed wire, and the examples given herein are not to be taken as limiting.

Installing sheep fencing is traditionally manually intensive requiring a line of posts to be in installed and the sheep netting secured to one at its free end and then unrolled and secured to each in turn. A particular problem is the tensioning of the netting which traditionally is done by attaching adjustable straining wires/cable to the netting and a post to apply tensioning to the netting. This is time consuming and has to be done every few metres to ensure adequate tensioning of the netting along the line of posts.

U.S. Pat. No. 5,163,634 describes apparatus for assisting in relation to the installation of sheep netting and comprises a frame adapted to be mounted to the rear of a tractor and provided with means for holding a roll of sheep netting. It is also provided with slidable means for gripping the wire against an abutment, which slidable means is operated by an hydraulic ram. Provision of the hydraulic ram makes the apparatus expensive to produce and the present invention arms to provide an alternative that is more economical to manufacture and dispenses with the heed for an hydraulically operated ram.

Any reference to a wire hereinafter should be interpreted to include netting unless the context dictates otherwise.

Accordingly, the present invention provides apparatus for dispensing and tensioning wire from a coil, comprising a frame for attaching to a vehicle, means for mounting at least one coil of wire for rotation, a lever arm member pivotally mounted with respect to the frame and having a guide co-operable with the wire in use, and a play-out path for the wire defined between an abutment of the frame and an abutment carried by the lever arm member, the lever arm having a first operative position in which the respective abutments are spaced apart to allow play-out of the wire around said guide, and the lever arm having a second operative position in which it is moveable pivotably about said pivot point to cause wire to be trapped between the respective abutments.

Preferably the wire mounting means is carried by the frame.

The lever arm is held in its first operative position by a locking member engageable between it and the frame. The second operative position of the lever arm is obtained by disengaging the locking member. In the first operative position wire when suitably anchored at its free end can be played out from the coil by moving the vehicle to which the apparatus is attached. In the second operative position of the lever arm member moving of the vehicle causes the wire to be tensioned. The tension in the wire acts via the lever arm to clamp the wire between the respective abutments. The more tension applied to the wire the greater the clamping force exerted between the abutments. The abutment of the frame may have a flat surface that is contacted by the abutment surface of the lever arm, although other shapes of abutment surface may be used.

The apparatus may be attached to any suitable vehicle.

The abutment carried by the frame is conveniently referred to as a fixed abutment, and the abutment carried by the lever arm is conveniently referred to as a moveable abutment as it is moveable with the lever arm.

The apparatus may be constructed to operate with the vehicle moving forward or backward or either forward or backward. To permit the apparatus to operate when the vehicle is moving forward or backward it is preferred to provide two fixed abutments which are spaced apart and to have the abutment of the lever arm disposed between them and pivotal to co-operate with one or the other of the frame abutments depending on whether the vehicle is to be operated in the forward or backward direction. In an alternative construction there are two spaced apart moveable abutments carried by the lever arm and one fixed abutment disposed therebetween carried by the frame. To that end the lever arm may have a bifurcated end. Thus, in each case, two play-out paths are provided, one for use when wire play-out and subsequent tensioning is to be done with the vehicle moving forward and one for use when wire play-out and tensioning is to be done with the vehicle moving backwards.

In a preferred embodiment the guide is disposed to one side of the pivot point and the abutment of the lever arm member is disposed to the opposite side of the pivot point of said lever arm member.

In an alternative embodiment the guide and the abutment of the lever arm are disposed in spaced apart relation, but they are disposed to one and the same side of the pivot point. The wire is threaded appropriately to one side or the other of the abutment according to the intended direction of movement to tension the wire in the second operation position of the lever arm. In the case of the alternative embodiment, the wire play-out path has to switch from one side of the lever arm where it passes the respective abutments, to the other side where it contacts the guide.

In both embodiments, the abutment of the lever arm is preferably located closer to the pivot point than the guide.

Conveniently, the aforementioned guide and abutments extend upwardly, usually vertically upwardly from, and usually perpendicularly to, a lower frame member of the frame or the lever arm as the case may be. The upward extent will vary according to the intended application in order to accommodate the desired width/height of fencing. This could vary from, for example, 3 m for security fencing, down to 50 mm or less for the likes of Bowden cable, single strand wire, razor wire, etc.

More conveniently the lever arm comprises two substantially parallel arm members connected by the at least one abutment and the guide. The guide is conveniently of circular cross section. Similarly, we have found it convenient to use an abutment of the lever arm member that is circular in cross section or at least curved over the area that makes contact with the abutment of the frame, or vice versa, although the clamp arrangement also works with abutment surfaces that are other than arcuate. For example, the abutment of the lever arm may be a square or rectangular box section with the corner thereof arranged to contact a flat abutment face of the frame. The corner of the box section has a small radius as is conventional with such sections.

Preferably there is a lower guide that extends beyond the aforesaid guide is referred to as a play-out guide to prevent wire from slipping off the guide. More preferably the said guide comprises a pair of spaced guide members defining a further play-out path for the wire. The pivot axis for the lever arm will usually be in a vertical plane. The abutments and guide or guides will usually be parallel to the pivot axis.

Conveniently the frame comprises upper and lower members connected by inter-connecting members at least one of which comprises the aforesaid frame abutment.

In normal use the lever arm is preferably arranged to extend to one side of the frame so as to position the play-out guide to one side of the vehicle to which the apparatus is attached. Attachment of the apparatus to the three-point linkage of a tractor or to the boom of a telescopic loader has advantages in use but the apparatus will work when secured by fixed mountings to other types of vehicles. Preferably the pivot connection between the lever arm member and the frame is readily releasable to allow the lever arm member to be re-positioned into a nonoperative transport position where it is no longer offset to one side of the frame.

Of course there may be situations where it is preferable to have the lever arm member operate to dispense wire in a line behind the vehicle and is not essential that it only be capable of operating when disposed to one side of frame and/or vehicle to which it is attached.

Another aspect of-the invention provides a method of installing wire fencing using any of the above-described apparatus, in which method the apparatus is mounted on a vehicle, at least one coil of wire is mounted on the apparatus and threaded through the play-out path with the lever arm locked in its first operative position, and the free end of the wire secured to a post, the method further comprising moving the vehicle in a desired direction and a desired distance causing wire to play-out from the coil, and then causing the lever arm member to adopt its second operative position and moving the vehicle further in the chosen direction by sufficient distance to actuate the clamp action of the lever arm to inhibit play-out of wire from the coil, and thereafter continuing to move the vehicle to tension the length of wire to a sufficient degree, providing one or more securing posts for the wire and securing the wire to the one or more of the posts to maintain the tension therein.

Figure 2:
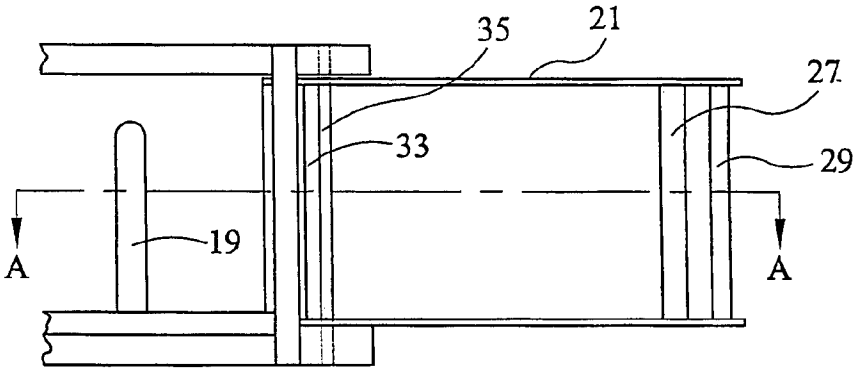
Figure 3:
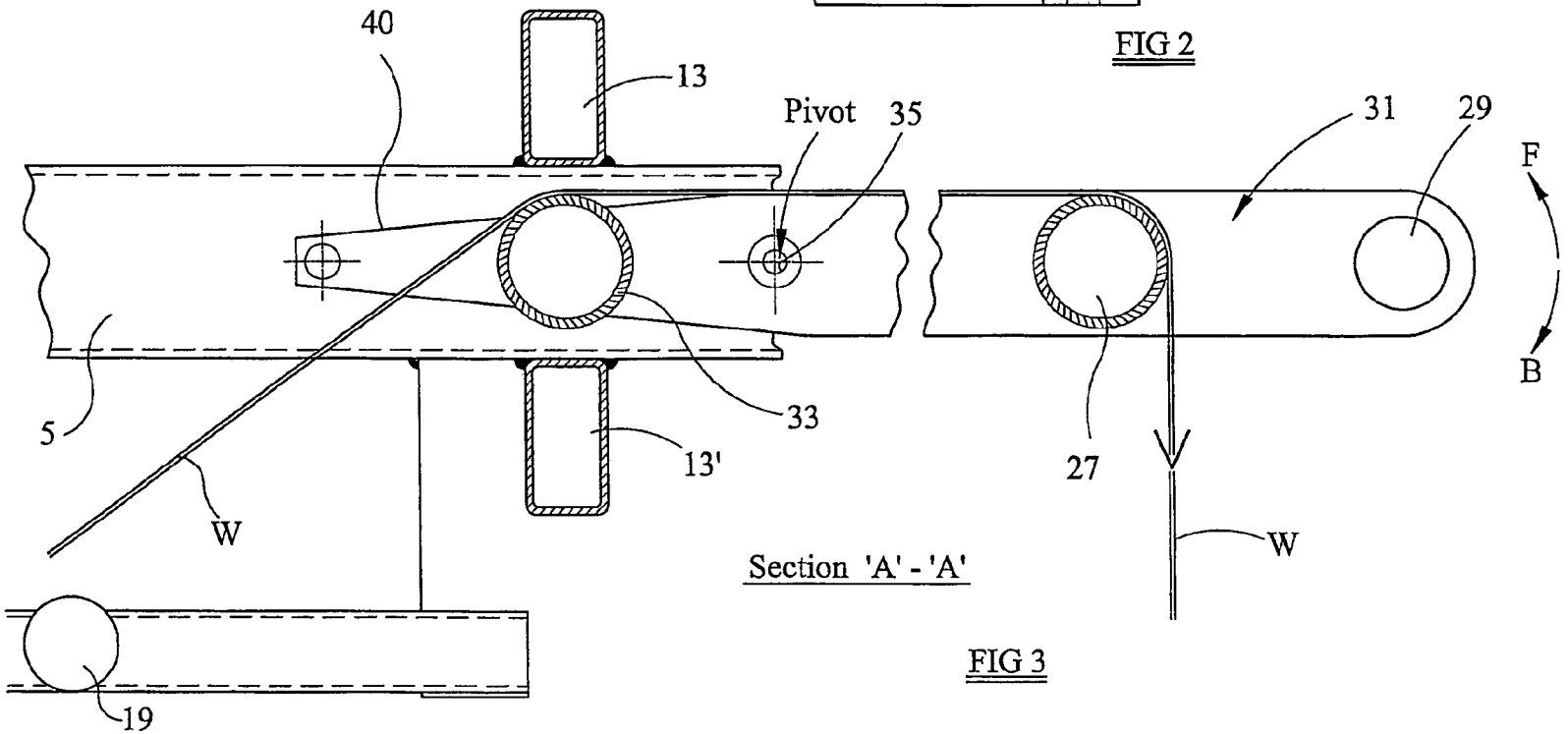
Figure 4:
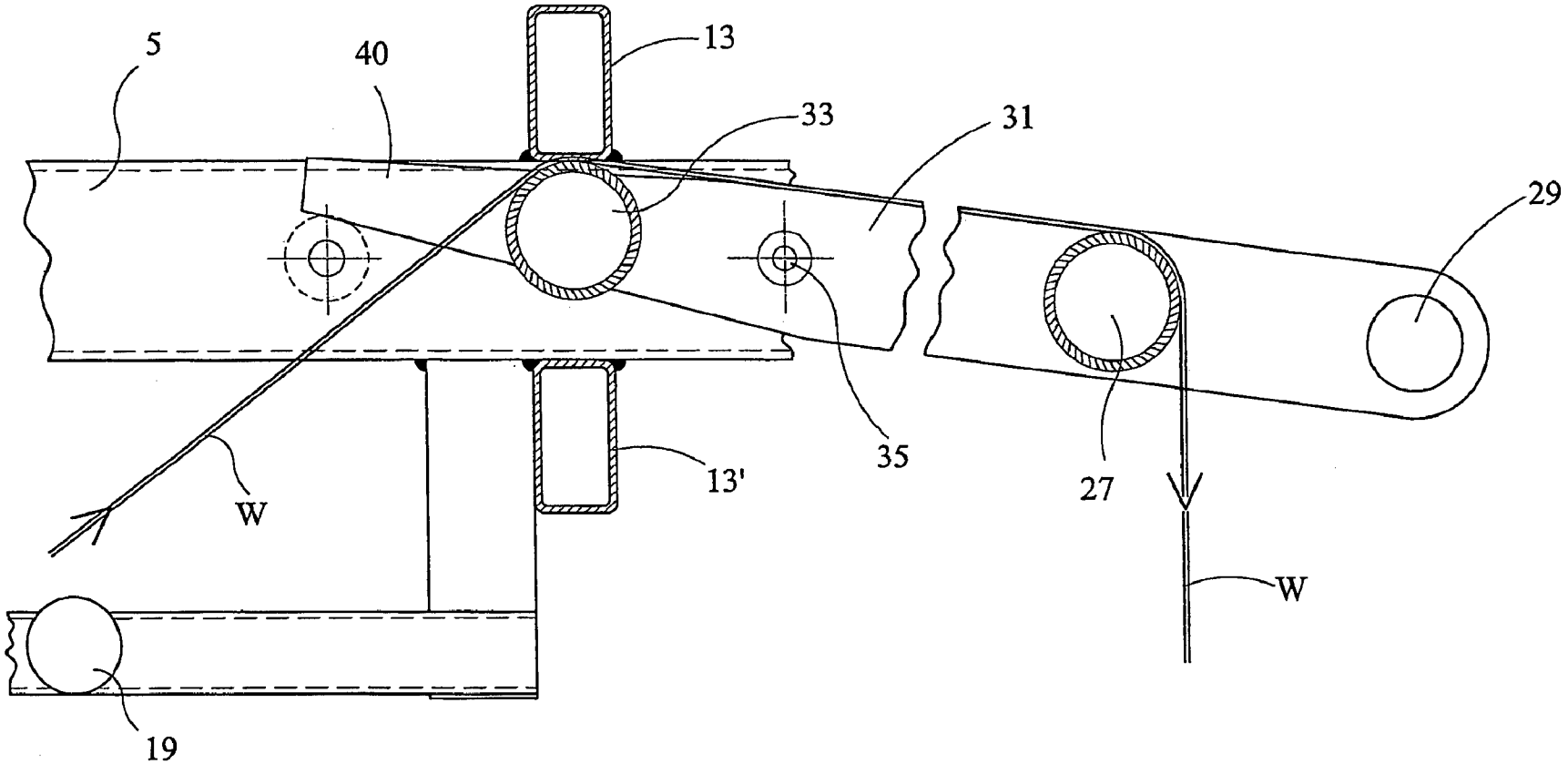
Figure 5:
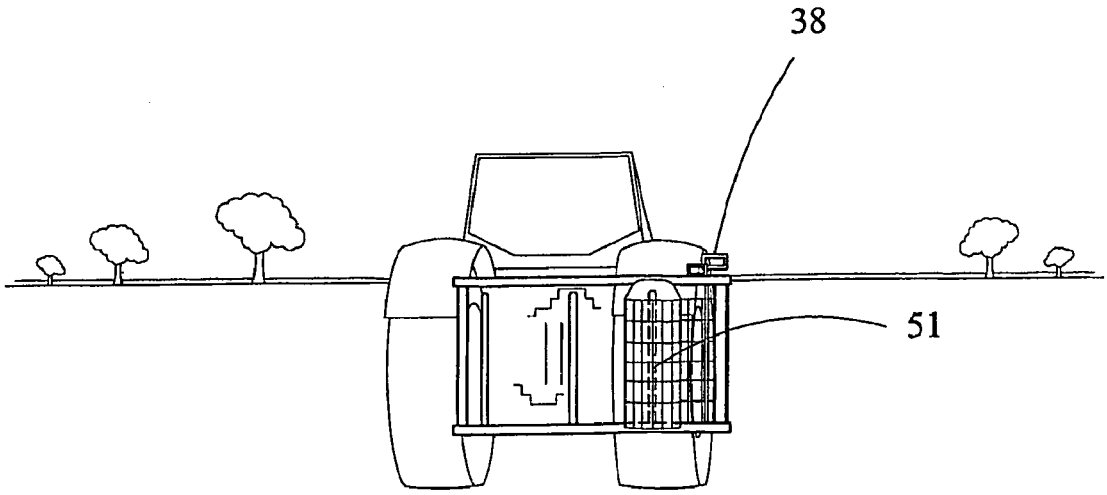
Figure 6:
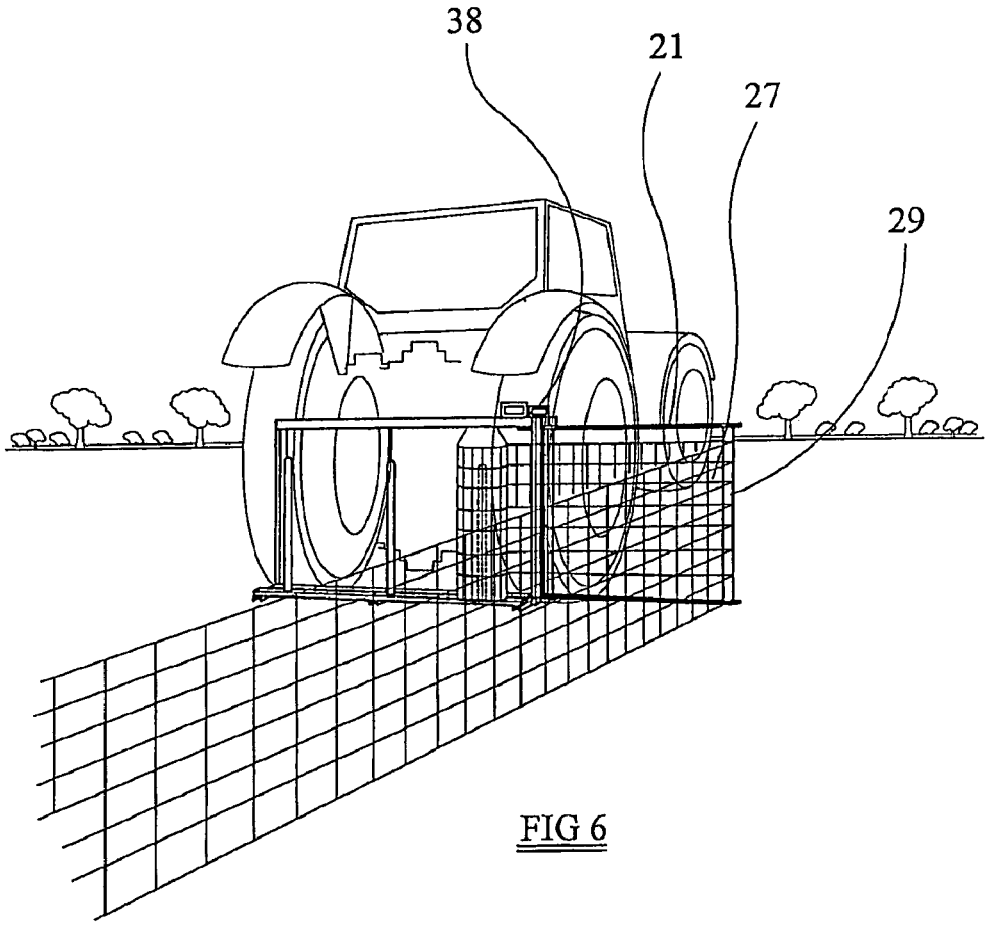
Figure 7:
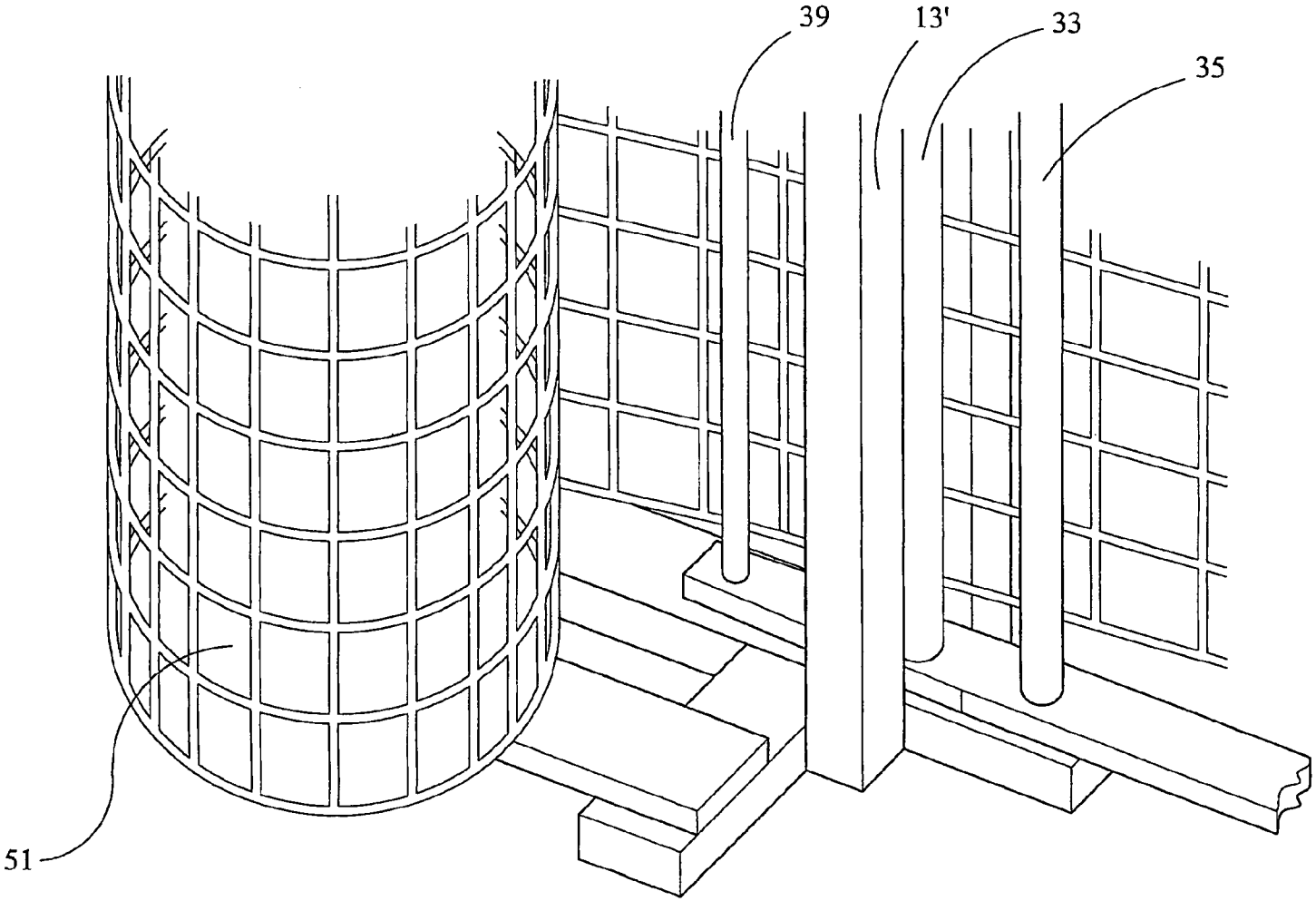

The present invention will now be described by way of example only with reference to the accompanying drawings; in which:

FIG. 1 is a perspective view of one embodiment of the apparatus according to the invention, FIG. 2 is a view on A of FIG. 1 showing part of the apparatus, FIG. 3 is a section on A-A of FIG. 2 showing the apparatus in a first position, FIG. 4 is a section on A-A of FIG. 2 showing the apparatus in a second operative position, FIG. 5 is a perspective view of the apparatus attached to a tractor in a transport/storage position, FIG. 6 is a perspective view of the apparatus attached to a tractor in its position of use, FIG. 7 is a fragmentary perspective view showing further details of the apparatus.

Figure 8:
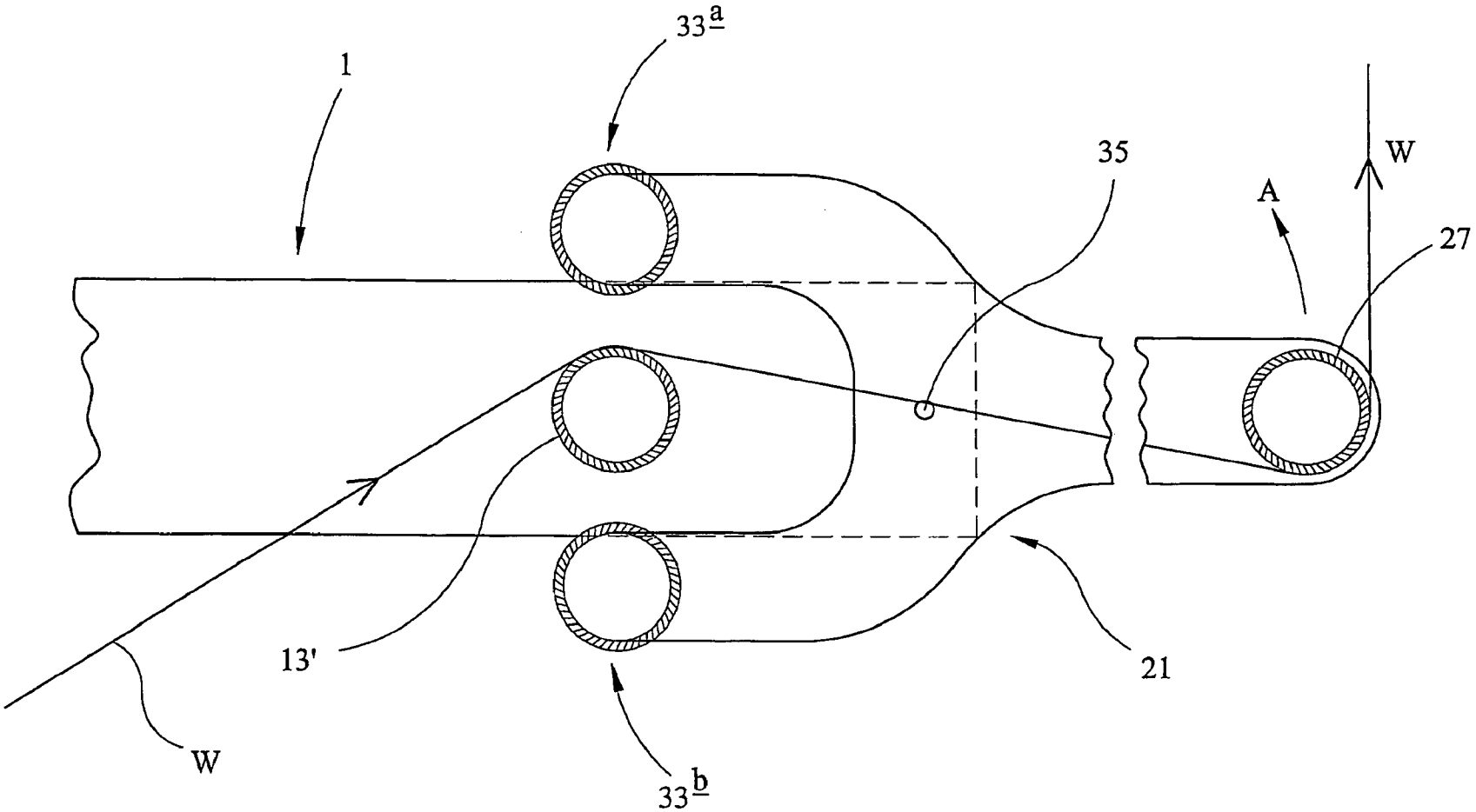
Figure 9:
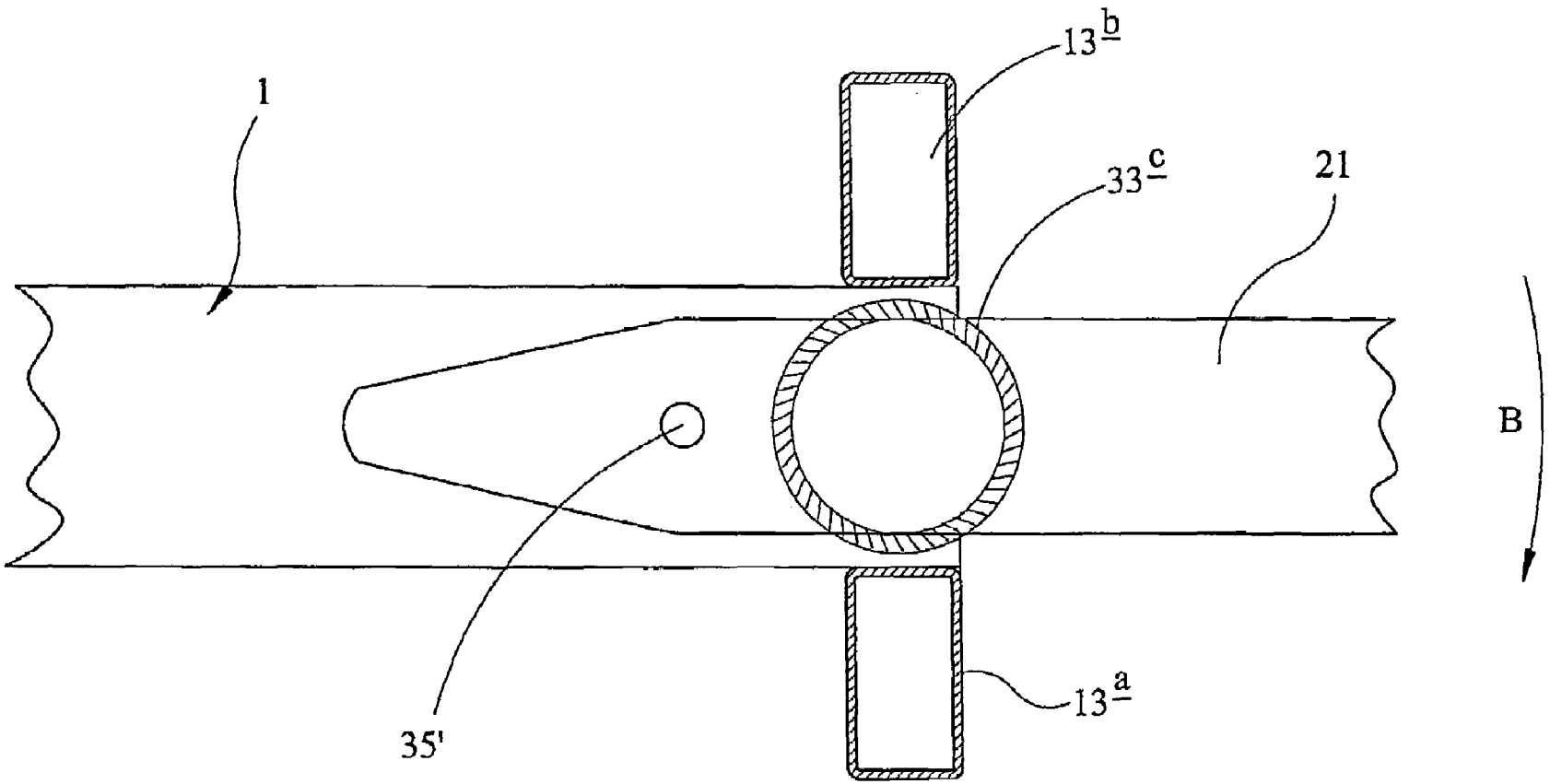

FIG. 8 is a fragmentary horizontal sectional view of an alternative embodiment of apparatus according to the invention, and FIG. 9 is a fragmentary horizontal sectional view of a further alternative embodiment of apparatus according to the invention.

Referring to the drawings of FIGS. 1 to 7, an example of apparatus according to the invention is described that is designed for attaching to the three-point linkage of a tractor. The apparatus comprises a frame 1 comprising upper and lower horizontal channel members 3,5 connected by vertical box section members 7, 9, 11, 13, one of which 13 serves as an abutment that is described further hereinafter. Uprights 7, 9, 11 are provided with respective mounting brackets 15 to be engaged by the three-point linkage of a tractor—see FIGS. 5, 6 and 7. For other vehicle applications the mounting brackets and/or the frame will be revised accordingly. The frame 1 carries a support member 17 that in turn carries upstanding mandrels 19 to receive coils of wire netting. Three mandrels are provided in the illustrated embodiment, but this is not to be taken as limiting.

The frame 1 provides a mounting for a lever arm member 21. The lever arm has a first operative position in which it is mounted fixedly with respect to the frame member—either as shown in FIG. 3 or FIG. 7 and discussed further hereinafter. The lever arm member 21 comprises upper and lower members 23,25 connected at one end by a pair of cylindrical members 27,29 defining a wire play-out guide 31. In use, extension of the lower arm member beyond guide 27 prevents wire netting dropping downwards off the guide 27. Guide 29 is optional, but preferred. The lever arm member further comprises an abutment member 33, conveniently formed as a cylindrical member and extending between the upper and lower arm members.

The frame 1 of the illustrated embodiment comprises a further abutment member 13' spaced from abutment 13 and defining a slot therebetween that receives the lever arm member 21. In its position of use the abutment member 33 is positioned adjacent the abutment 13, and where the further abutment 13' is provided, it is disposed between the two abutments 13, 13'.

The lever arm member 21 is connected to the frame by a pivot bar 35 which defines a pivot axis for the lever arm member 21. In the preferred embodiment, the pivot bar 35 is releasable. It has a shank that passes through aligned holes in the upper and lower members of the frame and the lever arm member. A handle 38 (only shown in FIGS. 5 and 6) at one end of the pivot bar 35 allows it to be inserted and removed as required and abuts with the upper frame member to hold it in position. With the pivot bar 35 removed, the lever arm member can be moved into a storage position—see FIG. 5.

A further releasable locking bar 39 (see FIGS. 5,6 and 7) is provided to secure the lever arm in a fixed position with respect to the frame. In a preferred embodiment the locking bar 39 has a shank that passes through aligned holes in the upper and lower members of the frame and co-operates with the upper and lower members of the lever arm member to prevent it moving. FIG. 3 illustrates one possible first operative position, with the lever arm fixed to define a wire play-out path between both abutments 13,13' and the abutment 33. However, a preferred arrangement is shown in FIG. 7, where the lever arm is moved so that the abutment 33 contacts one of the abutments 13,13' when in its fixed first operative position. This leaves only one wire play-out path. The tapered end 40 to the upper and lower arm members 23,25. The play-out path for the wire is shown at W and it will be seen that it engages the abutment 33 and the guide 27.

In use, a roll of wire netting 51 is placed on one of the mandrels 19, and the lever arm member 21 moved outwardly and the bar 35 placed in position so that the lever arm can pivot about the axis of the bar 35. The degree of pivoting is limited by engagement of the abutment 33 with one or other of the frame abutments 13,13'. If the wire is to be played-out during forward movement of the tractor, then the pivot arm is moved in the direction of arrow F—see FIG. 3—and the locking bar 37 inserted in position to locate the lever arm in a fixed position defining a wire play-out slot between abutment 13 and 33. The free end of the wire netting is then threaded through the play-out guide 31. If wire is to be played-out with the vehicle moving backwards then the arm is moved in the direction of arrow B and the bar 37 inserted. Wire is inserted through the resulting gap between abutments 13 and 13'. The following description assumes forward motion. The free end of the wire is attached to a post and the vehicle driven forwardly along the intended line of the fence. The vehicle can be driven a convenient distance, say 30 m or more. Then the locking bar 37 is removed and the vehicle driven forwardly a small amount. This causes the lever arm 21 to pivot about axis 35 and as a consequence the abutment 33 moves towards abutment 13 and traps the netting therebetween. Continued movement of the tractor results in the played-out length of wire netting being tensioned. Stopping the tractor retains the tension in the wire whilst it is secured to posts positioned along the line of the netting. Thus play-out of the wire and tensioning thereof is achieved in a very simple and efficient manner.

Whilst not illustrated in the drawings, the frame may carry an additional mandrel to carry a roll of barb wire or single strand wire as an addition to or as an alternative to the roll of wire netting.

Referring to FIG. 8, there is shown an alternative embodiment of apparatus in which the frame 1 has a single fixed abutment 13' and the lever arm member 21 which is pivotally mounted with respect to the frame is provided with two abutments 33*a*,33*b*. To facilitate this the lever arm has a bifurcated end carrying a respective one of the abutments 33*a*,33*b*. Note that the wire W is threaded between abutments 13' and 33*a* for the device to operate when tensioning movement is in the direction of arrow A. The lever arm and its pivotal convection is constructed in a similar manner to that described above, and its method of use is the same. In this illustrated example the pivot point 35 is disposed between the guide 27 and the abutments 33*a*,33*b* although another configuration could be adopted as will be apparent from the following description with reference to FIG. 9.

In FIG. 9, the construction illustrated with reference to FIGS. 1 to 7 is modified to re-position the pivot point 35' so that the abutment 33*c* mounted to the lever arm 21 and the guide thereof are disposed to the same side of the pivot point rather than to opposite sides. The guide 27,29 although not illustrated in FIG. 9 will be to the right hand end, as with the first embodiment and is not described in any detail. The locking means operate in the same manner as the first embodiment. The frame has two fixed abutments 13*a*,13*b* as with the first embodiment. The only change required for use compared with the first embodiment, is to thread the wire differently to take account of the fact that the moveable abutment now moves in the same direction as the guide when the lever arm pivots. Thus for a tensioning movement in the direction of arrow B, the wire has to run between abutment 33*c* and the abutment 13*a*, rather than 13*b*.

The invention claimed is:

1. An apparatus for dispensing and tensioning wire from a coil, the apparatus comprising:

a frame (1) for attaching to a vehicle;

mounting means (19), for mounting at least one coil of wire for rotation;

a lever arm member (21) pivotally mounted with respect to the frame and having a guide (27) co-operable with the wire in use;

a play-out path of the wire defined between an abutment (13) of the frame and an abutment (33) carried by the lever arm member, said guide (27) and abutment (33) of the lever arm member being disposed in spaced apart relation;

the lever arm member having a first operative position in which the respective abutments are spaced apart to allow play-out of the wire around said guide, and the lever arm member having a second operative position in which it is moveable pivotably about a pivot point to cause the wire to be trapped between the respective abutments;

a third abutment, wherein the lever arm member has a third operative position in which the lever arm member is pivotally moveable about said pivot point such that the wire is trapped between the abutment (33) and the third abutment;

wherein when the apparatus is connected to the vehicle, the wire is played-out regardless of whether the movement of the vehicle is in a forwards or reverse direction; and wherein the abutment is located between the other two abutments.

2. The apparatus as claimed in claim 1 wherein the wire mounting means (19) is carried by the frame (1).

3. The apparatus as claimed in claim 1 wherein the lever arm member (21) is held in the first operative position by a locking member (39) engageable between it and the frame, disengagement of the locking member enabling the lever arm to obtain the second operative position.

4. The apparatus as claimed in claim 1 wherein the abutment (13) carried by the frame is a fixed abutment and the abutment (33) carried by the lever arm is a moveable abutment.

5. The apparatus as claimed in claim 4 wherein two spaced apart fixed abutments (13, 13') are provided with the moveable abutment (33) of the lever arm being disposed therebetween, the moveable abutment being pivotal to co-operate with one or other of the frame abutments depending upon whether the vehicle is to be operated in the forward or backward direction.

6. The apparatus as claimed in claim 4 wherein two spaced apart moveable abutments (33*a*, 33*b*) are provided carried by the lever arm with the fixed abutment (13') disposed therebetween carried by the frame.

7. The apparatus as claimed in claim 6 wherein the lever arm has a bifurcated end.

8. The apparatus as claimed in claim 1 wherein the guide (27) is disposed to one side of the pivot point (35) and the abutment (33) of the lever arm member is disposed to the opposite side of the pivot point of the lever arm member.

9. The apparatus as claimed in claim 1 wherein the guide (27) and the abutment (33) of the lever arm member are disposed in a spaced apart relation and on the same side of the pivot point.

10. The apparatus as claimed in claim 9 wherein the wire is threaded appropriately to one side or the other of the abutment according to the intended direction of movement to tension the wire in the second operative position of the lever arm.

11. The apparatus as claimed in claim 8 wherein the abutment (33) of the lever arm is located closer to the pivot point (35) than the guide (27).

12. The apparatus as claimed in claim 1 wherein the guide (27) and abutments (13,33) extend upwardly from a lower frame member (5, 25) of the frame or the lever arm member.

13. The apparatus as claimed in claim 12 wherein the guide and abutments extend vertically upwardly and perpendicularly to the lower frame member or lever arm member.

14. The apparatus as claimed in claim 1 wherein the lever arm member (21) comprises two substantially parallel arm members (23, 25) connected by the at least one abutment (33) and the guide (27).

15. The apparatus as claimed in claim 1 wherein the guide (27) is of circular cross section.

16. The apparatus as claimed in claim 1 further comprising a lower guide (29) extending beyond the guide (27) to prevent wire from slipping off the guide.

17. The apparatus as claimed in claim 1 wherein the pivot axis (35) for the lever arm member (21) is in a vertical plane.

18. The apparatus as claimed in claim 1 wherein the abutments (13, 33) and guide or guides (27) are parallel to the pivot axis (35).

19. The apparatus as claimed in claim 1 wherein the frame (1) comprises upper and lower members (3, 5) connected by inter-connecting members (7, 9, 11, 13) at least one of which comprises the frame abutment (13).

20. The apparatus as claimed in claim 1 wherein, in use, the lever arm member (21) is arranged to extend to one side of the frame so as to position the play-out guide to one side of the vehicle to which the apparatus is attached.

21. The apparatus as claimed in claim 1 wherein the pivot connection between the lever arm member (21) and the frame (1) is readily releasable to allow the lever arm member to be re-positioned into a non-operative transport position.

22. A method of installing wire fencing using an apparatus as claimed in claim 1, the method comprising:

mounting the apparatus on said vehicle, mounting at least one coil of wire on the apparatus and threading the wire through the play-out path provided with the lever arm member locked in its first operative position, the free end of the wire being secured to a post, the method further comprising moving the vehicle in a desired direction and a desired distance causing wire to play-out from the coil and then causing the lever arm member to adopt its second operative position and moving the vehicle further in the chosen direction by a distance to actuate the clamp action of the lever arm member to inhibit play-out of wire from the coil, and thereafter continuing to move the vehicle to tension the length of wire to a degree, providing one or more securing posts for the wire and securing the wire to the one or more of the posts to maintain the tension therein.

* * * * *